US011117032B2

(12) United States Patent
Falbo

(10) Patent No.: US 11,117,032 B2
(45) Date of Patent: Sep. 14, 2021

(54) STATIC TARGETING APPARATUS FOR IMPROVING ACCURACY AND METHOD

(71) Applicant: Vincent Falbo, Webster, NY (US)

(72) Inventor: Vincent Falbo, Webster, NY (US)

( * ) Notice: Subject to any disclaimer, the term of this patent is extended or adjusted under 35 U.S.C. 154(b) by 0 days.

(21) Appl. No.: 16/390,851

(22) Filed: Apr. 22, 2019

(65) Prior Publication Data

US 2019/0344141 A1 Nov. 14, 2019

Related U.S. Application Data

(60) Provisional application No. 62/668,719, filed on May 8, 2018.

(51) Int. Cl.
*A63B 63/00* (2006.01)
*A63B 71/02* (2006.01)
*A63B 63/08* (2006.01)

(52) U.S. Cl.
CPC ..... *A63B 63/003* (2013.01); *A63B 63/083* (2013.01); *A63B 71/023* (2013.01)

(58) Field of Classification Search
CPC ..... A63B 63/083; A63B 2225/093; A63B 2208/12; A63B 69/0071
USPC ..... 473/447, 479–486
See application file for complete search history.

(56) References Cited

U.S. PATENT DOCUMENTS 4,588,188 A * 5/1986 Mahoney ..... A63B 63/083 473/481
4,895,365 A * 1/1990 Schroeder ..... A63B 63/083 473/481
4,948,127 A * 8/1990 Willard ..... A63B 63/083 473/483
5,279,496 A * 1/1994 Schroeder ..... A63B 63/083 248/219.4
5,316,290 A * 5/1994 Parr ..... A63B 63/083 473/483
5,346,207 A * 9/1994 Heinen ..... A63B 63/083 473/481
5,480,139 A * 1/1996 Owen, Jr. ..... A63B 63/083 473/485
5,695,415 A * 12/1997 Docherty ..... A63B 69/0071 40/453
5,800,290 A * 9/1998 Barry ..... A63B 63/00 473/438
5,800,296 A * 9/1998 Shaw ..... A63B 63/083 473/483
6,155,938 A * 12/2000 Mower ..... A63B 63/083 248/280.11
6,368,240 B1 * 4/2002 Pohrer ..... A63B 63/083 473/483
6,758,768 B2 * 7/2004 Spencer ..... A63B 63/083 473/472
7,306,530 B2 * 12/2007 Connerley ..... A63B 63/083 473/483

(Continued)

*Primary Examiner* — Jeffrey S Vanderveen

(74) *Attorney, Agent, or Firm* — Andrew G. Morabito

(57) ABSTRACT

A static targeting apparatus for basketball, comprising; a mounting bracket, wherein the mounting bracket has a plurality of connection means to secure to a backboard, a vertical member having a first end and a second end, wherein the vertical member is attached to the mounting bracket, and a direction marker, wherein the direction marker is attached to the backboard, wherein, the direction marker is positioned relative to the hoop.

15 Claims, 5 Drawing Sheets

(56) References Cited

U.S. PATENT DOCUMENTS

| | | | | |
|---|---|---|---|---|
| 7,713,149 | B2 * | 5/2010 | Docherty | A63B 63/083 473/422 |
| 8,986,140 | B1 * | 3/2015 | Fuller | A63B 69/0071 473/422 |
| 2002/0082127 | A1 * | 6/2002 | Pohrer | A63B 63/083 473/489 |
| 2003/0171171 | A1 * | 9/2003 | Fair | A63B 63/083 473/483 |
| 2003/0216195 | A1 * | 11/2003 | Britto | A63B 63/083 473/481 |
| 2004/0266567 | A1 * | 12/2004 | O'Neill | A63B 63/083 473/481 |
| 2005/0003909 | A1 * | 1/2005 | Tsinberg | A63B 63/083 473/481 |
| 2007/0010354 | A1 * | 1/2007 | White | A63B 69/0071 473/447 |
| 2016/0193518 | A1 * | 7/2016 | Baxter | A63B 24/0062 473/450 |

* cited by examiner

STATIC TARGETING APPARATUS FOR IMPROVING ACCURACY AND METHOD

CROSS-REFERENCE TO RELATED APPLICATIONS

This application is a continuation and claims the benefit of priority under 35 USC 120 of U.S. application No. 62/668,719 filed Apr. 22, 2017. The disclosure of the prior applications is considered part of (and is incorporated by reference in) the disclosure of this application.

BACKGROUND OF THE INVENTION

The present invention relates to a basketball target for improving accuracy, and more particularly to a portable static training device mounted on a basketball backboard that creates a focus point for goal shooting at any location on the court.

Organized basketball play is governed by different organizations dependent on the level of play: NBA, NCAA, High School, and recreational leagues associated with communities are some of these governing bodies. The governing bodies dictate the basketball goal, and it is comprised of a ring known as a "rim," that is mounted on a vertical member referred to as a backboard. There is a net suspended from the rim. Points are scored when the ball passes through the rim. It may pass directly through the rim without touching the rim or backboard, it may ricochet off of the rim before passing through, or it may hit the backboard first and ricochet off of the backboard directly through the rim or ricochet off of the rim before passing through it. The shots that ricochet off the backboard before passing through the rim are most often referred to as "bank shots."

It is well known in the sport of basketball, that it is much easier to successfully complete various shots to the basket when knowing the precise location of the backboard to hit for a bank shot. Typically, the serious basketball player will spend many hours in on-court or off-court practice, with or without opponents, practicing shots from all over the court to improve their accuracy. However, this method creates a trial and error style training to find the perfect location to aim for on the backboard when performing a bank shot.

The prior art attempts to identify universal target locations for bank shots and targeting mechanisms that provide a focus point. However, the present invention provides the player with many different focus points to aim at that are determined based on the players position on the court, and based on a player's position, the apparatus determines where the ball should contact the backboard for the highest percentage chance of successfully completing a bank shot.

BRIEF SUMMARY OF THE INVENTION

In a first embodiment the present invention is a static targeting apparatus for basketball, comprising: a basketball assembly, wherein the basketball assembly comprises a backboard, a rim attached to the backboard, and a support for the basketball backboard; a mounting bracket, wherein the mounting bracket has a plurality of connection means to secure to a backboard; a vertical member having a first end and a second end, wherein the vertical member is attached to the mounting bracket; and a direction marker, wherein the direction marker is attached to the backboard; wherein, the direction marker is positioned relative to the rim.

In an additional embodiment the present invention is a static targeting apparatus for basketball, comprising: a basketball assembly, wherein the basketball assembly comprises a backboard, a rim attached to the backboard, and a support for the basketball backboard; a mounting bracket, wherein the mounting bracket has a plurality of connection means to secure to a backboard; a vertical member having a first end and a second end, wherein the vertical member is attached to the mounting bracket at a first end and the vertical member is telescopic; and a direction marker, wherein the direction marker is attached to the backboard and the direction marker is positioned relative to the rim.

In yet an additional embodiment, the present invention is a static targeting apparatus for basketball, comprising: a mounting bracket, wherein the mounting bracket has a plurality of connection means to secure to a backboard; a vertical member having a first end and a second end, wherein the vertical member is attached to the mounting bracket; and a direction marker, wherein the direction marker is attached to the vertical member or the mounting bracket; wherein, the direction marker is positioned relative to the vertical member.

In yet an additional embodiment, the present invention is a static targeting apparatus for basketball, comprising: a vertical member having a first end and a second end, wherein the first end and the second end of the vertical member have detachable locking mechanisms; and a direction marker, wherein the direction marker is attached to the backboard; wherein, the direction marker is positioned relative to the vertical member.

DETAILED DESCRIPTION OF THE INVENTION

Figure 1:
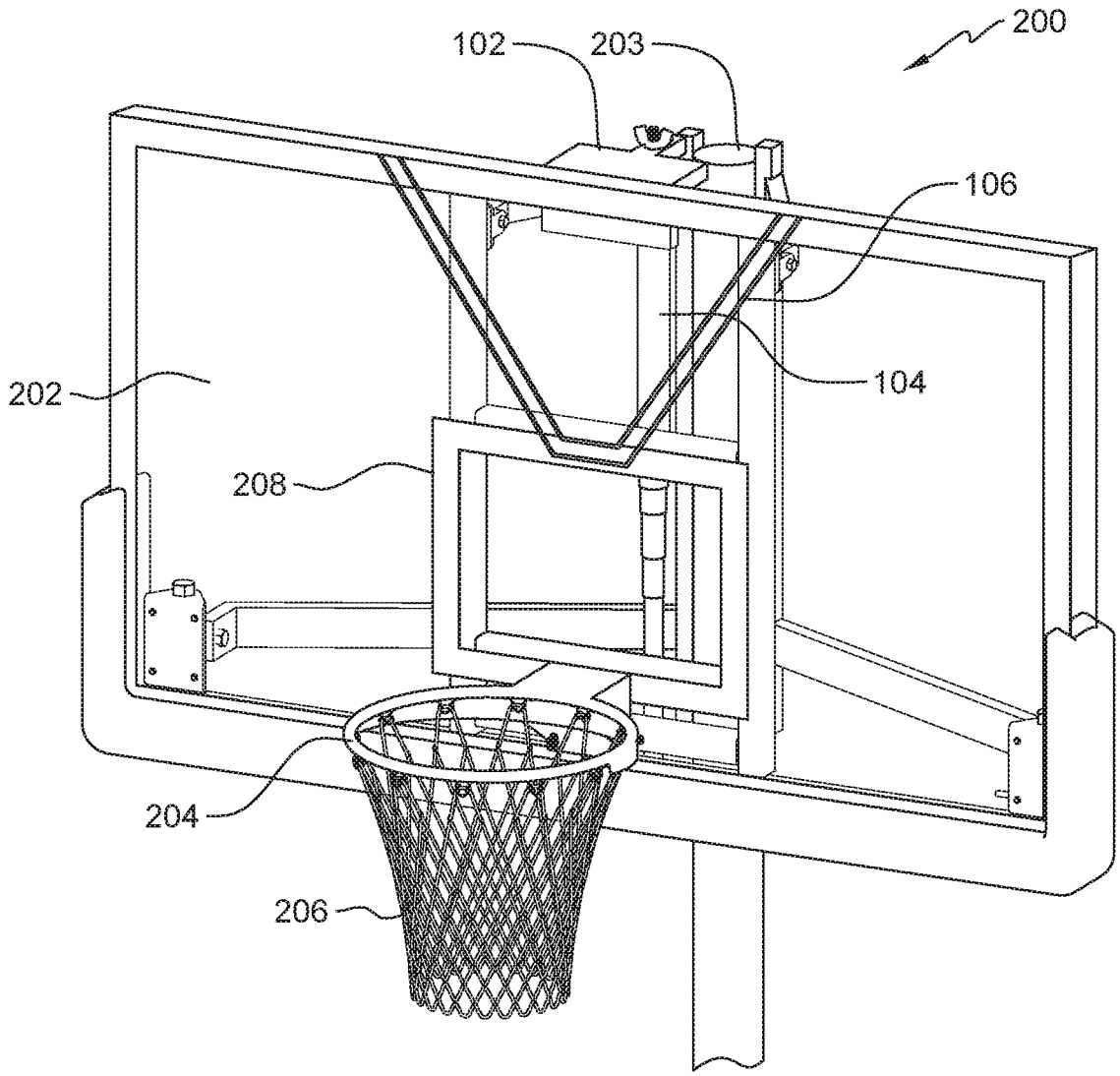
FIG. 1 depicts a perspective view of the targeting apparatus attached to a basketball assembly from a front view, in accordance with one embodiment of the present invention.

The present invention provides a targeting device for improving bank shot accuracy from a plurality of locations on the basketball court. The targeting device is attached to the backboard through various methods and through a clear, opaque, or translucent backboard the player is able to see the targeting device and pinpoint the ideal location to aim for on the backboard to successfully complete a bank shot. Due to the various factors that affect the success of the bank shot, the targeting device provides a static object to target while planning the shot for players of all heights. The static targeting device allows a player (of all heights) to practice the shot with the knowledge that aiming for a point along the targeting device greatly increases the likelihood of completing a successful shot.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention. It is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, the preferred methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present invention is not entitled to antedate such publication by virtue of prior invention. Further, the dates of publication provided may be different from the actual publication dates which may need to be independently confirmed.

It must be noted that as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements or use of a "negative" limitation.

Figure 2:
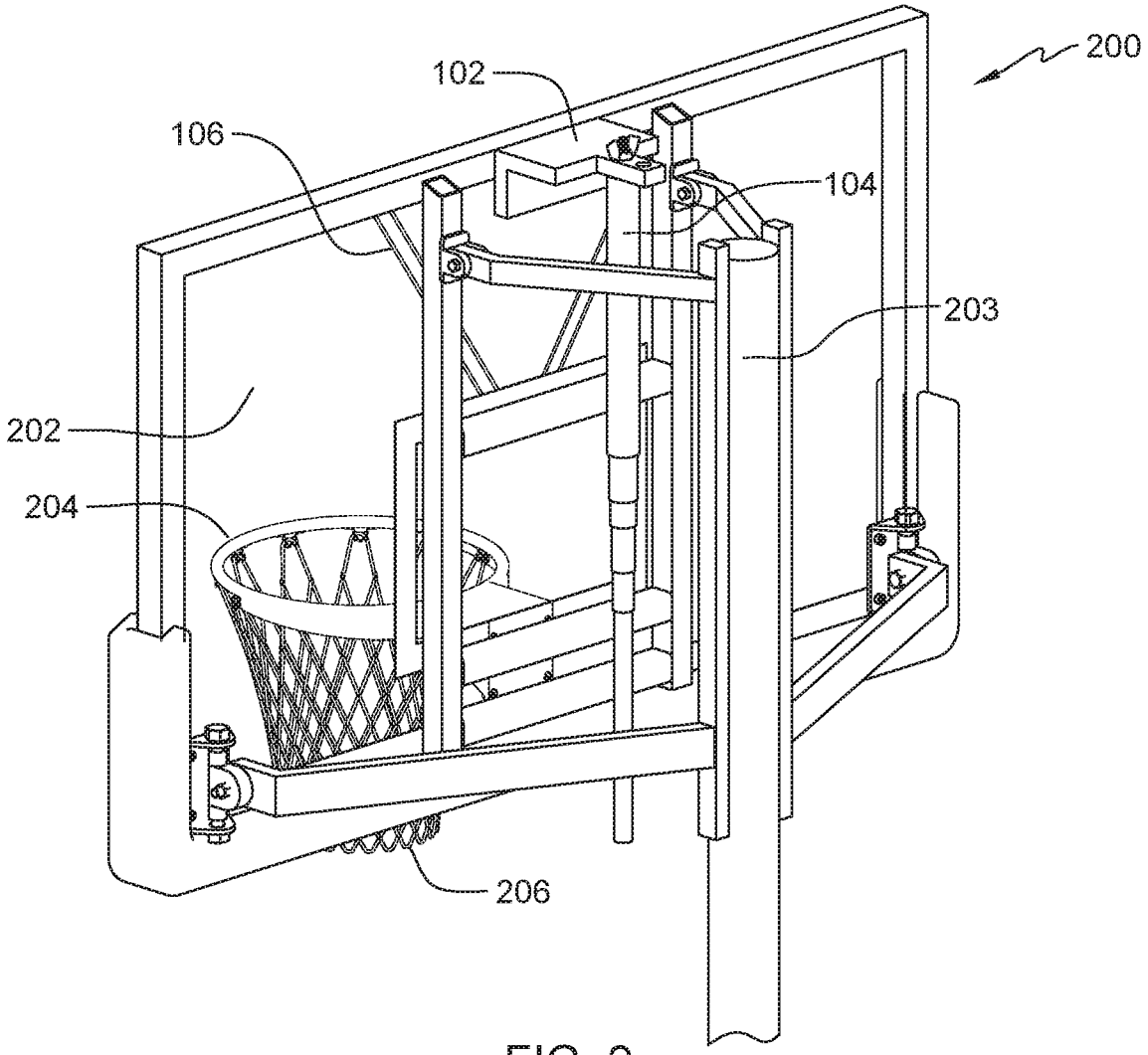
FIG. 2 depicts a perspective view of the targeting apparatus attached to a basketball assembly from a rear view, in accordance with an embodiment of the present invention.

FIGS. 1-2 depicts a perspective view of the targeting apparatus 100 attached to a basketball assembly 200, in accordance with one embodiment of the present invention. The targeting apparatus 100 is designed to assist with improving the accuracy for bank shots. Through a more precise targeting method, the targeting apparatus 100 provides a location on the backboard to aim for which greatly increases the accuracy of the bank shot. The targeting apparatus 100 is designed to secure (either permanently or removably) to the basketball assembly 200. The depicted embodiments below show various designs and methods for the targeting apparatus 100 to secure to the basketball assembly 200 with the same intended purpose of assisting the player with successfully completing a bank shot.

The basketball assembly 200 is shown in conjunction with a conventional transparent basketball backboard 202 and freestanding goal assembly, however, it should be understood that the present training device may also be mounted on wall and ceiling mounted goals. The major components of the basketball assembly 200 generally include a generally planar transparent backboard 202 having a front side, a back side, a top end, a bottom end and lateral sides, with a rim 204 and a net 206 mounted on the front side near the bottom end of the backboard 202. Transparent backboards 202 also typically include a rectangle 208 on the front side centered behind the rim 204. The support structure 203 is used to support the backboard 202 and comes in many different styles and designs and are well known in the art, and therefore are not shown and described in detail. The targeting apparatus 100 is designed to fit the many different types of backboards 202 and support structures 203 through adjustments and modifications to placement of openings and apertures for mounting the targeting apparatus to the various types of backboard frames and support structures.

Figure 3:
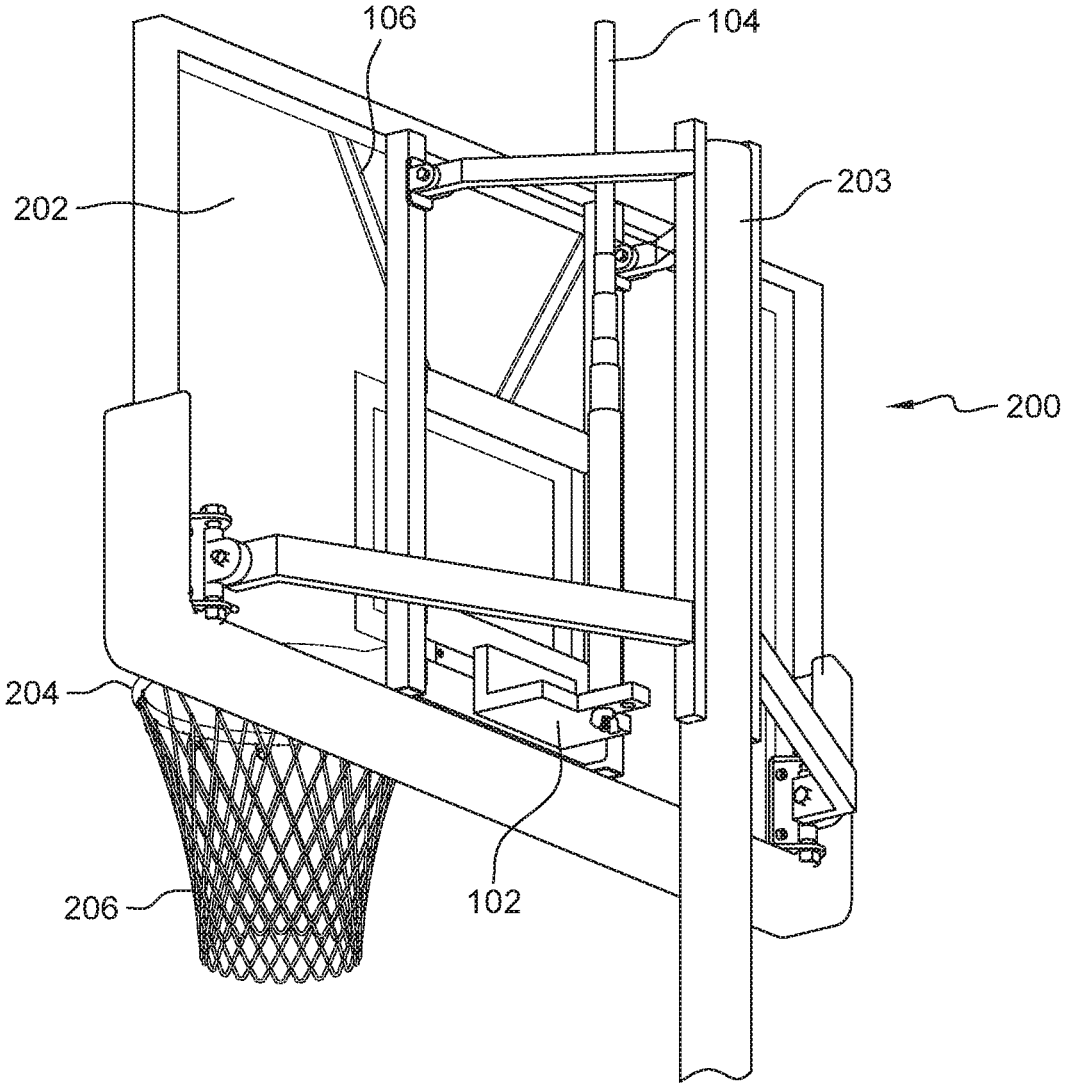
FIG. 3 depicts a perspective view of the targeting apparatus attached to a basketball assembly, in accordance with another embodiment of the present invention.

In the embodiment depicted in FIGS. 1-2, the mounting bracket 102 is mounted at the top end of the backboard 202, and the vertical member 104 is directed towards the bottom of the backboard 202. In the embodiment depicted in FIG. 3, the mounting bracket 102 is attached to the bottom end of the backboard 202 and the vertical member 104 is directed towards the top of the backboard 202. In additional embodiments, there may be mounting brackets 102 attached to the top end and the bottom end of the vertical member 104. This will further assist in securing the vertical member 104 so that when the basketball or player interact with the backboard 202 and shake the backboard 202, the vertical member 104 will remain stationary. There may be additional brackets used to secure the vertical member 104 in place, for instance a bracket at the top end and bottom end of the vertical member 104 may be used. In additional embodiments, the mounting bracket 102 may be secured to the hoop 204.

The direction marker 106 is used in conjunction with the targeting apparatus 100 to further assist the player in finding the ideal location to aim for on the backboard 202 when performing a bank shot. The direction marker 106 when used in conjunction with the vertical member 104 creates a point of intersection between the vertical member 104 and the direction marker 106 that can be seen from any point on the court that gives the player the ideal location to hit the backboard 202 to successfully complete the bank shot. In some embodiments, the direction marker 106 is attached to the mounting bracket 102 or the vertical member 104. The direction marker 106 may be detachable from the backboard 202, through either being a removable sticker or various removable fastening mechanisms, e.g. suction cups, magnets, or hook and loop style fasteners.

The direction marker 106 is comprised of a horizontal member and two angled members, one angled member extending from each end of the horizontal member. In the depicted embodiment, the direction marker 106 is comprised of a first line and a second line. The two lines allow for easier viewing of the vertical member 104 behind the direction marker in the depicted embodiment, the direction marker 106 is comprised of two lines, but can be one solid piece as well. The two angled members provide the ideal location to aim for when performing a bank shot when not square with the rim 204. When the player lines up to take the shot, they identify the location where the direction marker 106 intersects with the vertical member 104 and aims for that spot.

The location of the vertical member 104 and the direction marker 106 is crucial for the successful operation of the targeting apparatus 100. The vertical member 104 and the direction marker 106 are substantially centered with the center of the rim 204 and the rectangle 208. The center axis of the vertical member 104 is positioned 3.326 inches behind the front surface of the backboard 202. The direction marker 106 is placed 12.86 inches above the rim 204. Measured from the center point of the horizontal member (or the center point of the first line and second line of the horizontal member), the horizontal member of the direction marker 106 extends 1.925 inches from the center vertical axis of the rim 204. The angled members of the direction marker 106 extend from the horizontal member at an angle of 126.822 degrees towards the out edge of the backboard 202 respectively. In additional embodiments, the angle may be within 10 degrees (greater than or less than) of the 126.822 degrees. The angled members of the direction marker 106 may extend to the outer edge of the backboard 202 or may end short depending on the size of the backboard 202. Ideally the angled members of the direction marker 106 extend far enough that an intersection of the direction marker 106 and the vertical member 104 can be seen from anywhere on the court. Through this specific embodiment, the vertical member 104 and the direction marker 106 are positioned in the ideal location for a person from anywhere on the court to see the visual intersection of these two elements. Where the direction marker 106 and the vertical member 104 intersect, from the player's perspective, that is the ideal location to aim for, for a high-percentage bank shot. The vertical member 104 may come in various lengths, diameters, shapes, and sizes based on the size and type of basketball backboard and design.

Figure 4:
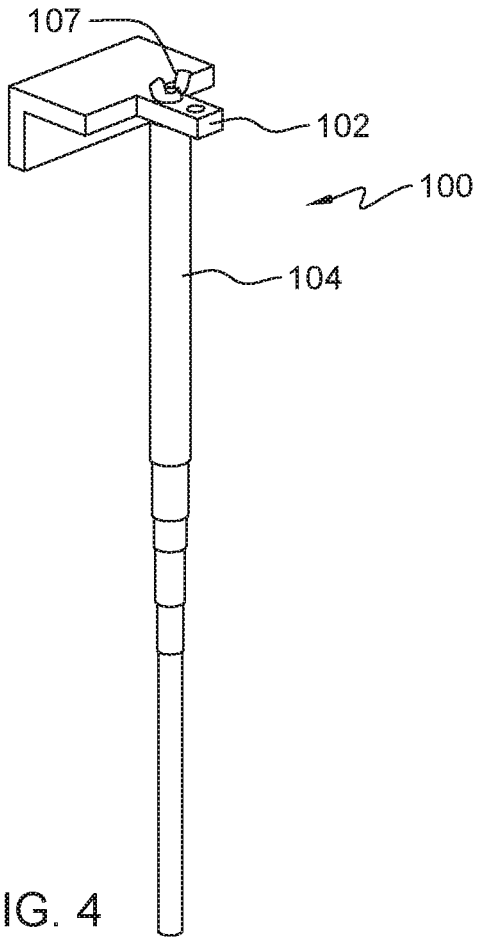
FIG. 4 depicts a perspective view of the targeting apparatus, in accordance with an embodiment of the present invention.

FIG. 4 depicts the targeting apparatus 100, in accordance with one embodiment of the present invention. The targeting apparatus 100 is comprised of a mounting bracket 102, a vertical member 104 and used in conjunction with the direction marker 106. The vertical member 104 is secured to the mounting bracket 102 with the use of a fastener 107. Various types of fasteners may be used, and are known to one skilled in the art.

The vertical member 104 is designed to provide the "target" for the player to aim for when performing a bank shot. The vertical member 104 may have various markings and decals used to further assist players by having a more distinct and identifiable point along the vertical member 104 to aim for. In the depicted embodiment, the vertical member 104 is a telescopic tube and the length can be adjusted. In some embodiments, the vertical member 104 is a plurality of sections 109 that are extendable. The sections 109 are able to be extended individually, and do not have to extend to the maximum length, to remain in position. With the ability to extend the vertical member 104 sections 109 independently, the targeting apparatus 100 is able to be used on a variety of support structures 203. For example, in the depicted embodiment, the vertical member 104 is able to extend fully. In additional examples, the support structure 203 may make it impossible for the vertical member 104 to fully extend. Therefore, the vertical member 104 is able to extend to its maximum length based on the support structure 203 design and maintains that length even with the shaking and rocking of the backboard 202 and maintain that length and position without the need of additional components. This may be accomplished by each section having an individual locking mechanism, such as, but not limited to, friction fit style locking mechanism, a twist lock, a pressure fit, quick release pins, clamps, or the like. In additional embodiments, the vertical member 104 may be a solid component. The vertical member 104 is at least the length of half of the basketball backboard 202 height. In most embodiments, the vertical member is substantially the same height as the basketball backboard 202.

The vertical member 104 is designed to be attached to the mounting plate 102. In some embodiments, the vertical member 104 has a threaded extension from at least one end, the threaded extension is designed to fit through one of the apertures (101 or 103) of the mounting bracket 102 and secured in place through the use of a fastener 107. In additional embodiments, the apertures (101 and/or 103) of the mounting bracket 102 are threaded and the vertical member 104 secures directly to the mounting bracket 102.

In various embodiments, the vertical member 104 is made from different materials. For example, it could be aluminum, steel, plastic, or other synthetic or natural materials. The vertical member 104 could be tapped to accept a bolt, threaded rod, or other threaded hardware to keep it abutted to the mounting bracket 102. The vertical member 104 could also be threaded to attach a type of nut or another element to keep it abutted to the mounting bracket 102. If the vertical member 104 is made from PVC, other plastic or other synthetic material, it could be abutted to the mounting bracket 102 with other hardware. The spacer elements could be various nuts, threaded bushings, threaded bungs, anti-vibration mounts, standoffs, coupling nuts, or other synthetic and natural material elements that keep the vertical member 104 at the correct location behind the backboard 202. In additional embodiments, various covers or markers may be attached or secured to the vertical member 104 which are movable to further adjust the target for the player.

Figure 5:
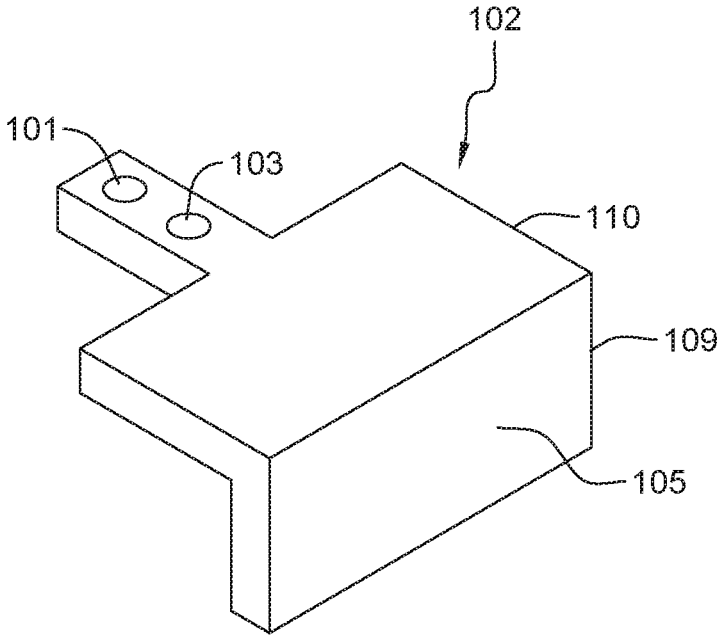
FIG. 5 depicts a perspective view of the mounting bracket, in accordance with an embodiment of the present invention.

FIG. 5 depicts the mounting bracket 102, in accordance with one embodiment of the present invention. The mounting bracket 102 has an "L" design, so that once connected to the backboard 202, a portion of the mounting bracket 102 is parallel to the rim 204. The mounting bracket 102, in the depicted embodiment, is attached to the backboard 202 through a removable attachment mechanism integrated into or secured to surface 105. This attachment mechanism may be, but not limited to suction cups, re-closeable fasteners (e.g. Dual-Lock) hook and loop style fasteners, magnets, or various other removable attachment mechanisms. In some embodiments, the mounting bracket 102 secures to the mounting points of the rim 204.

In the depicted embodiment, the mounting apertures 101 and 103 are a plurality of openings at predetermined locations on the mounting bracket 102, designed to receive the vertical member 104, so that the vertical member 104 is properly positioned relative to the mounting bracket 102. The mounting apertures 101 and 103 are a predetermined distance from the front surface 105 of the mounting bracket 102 so that, when the mounting bracket 102 is secured to the rear surface of the backboard 202, the vertical member 104 is the proper distance from the front surface of the backboard 202. In the depicted embodiment, there are two mounting apertures 101 and 103, so that if the thickness of the backboard 202 varies, the user is able to adjust the position of the vertical member. In some embodiments, the apertures 101 and 103 are replaced with a slot, and the vertical member 104 is able to be moved along the slot based on the desired position. This embodiment provides for greater versatility-based on the thickness of the backboard 202. In these embodiments, where a slot is used instead of apertures, there are markings on the mounting bracket 102 to indicate the specific position for the vertical member 104 to be positioned relative to the basketball assembly 200 design and features.

FIG. 5 depicts a perspective view of the mounting bracket 102, in accordance with an embodiment of the present invention. The mounting bracket 102 has a vertical portion 109 and a horizontal portion 110. The vertical portion 109 is designed to be secured to the backboard 202, and the horizontal portion 110 is designed to receive the vertical member. In the depicted embodiment, the horizontal portion 110 has an extension with a plurality of apertures to receive the vertical member 104. In various embodiments, the shape and size of the horizontal portion 110 and the vertical portion 109 is variable, provided the location of the apertures provides the proper distance for the vertical member 104 relative to the rim 204. In the depicted embodiment, the mounting bracket 102 is shown with the two apertures 101 and 103 for the vertical member 104 to secure to. The purpose of the two apertures 101 and 103 is to allow for versatility of the placement of the vertical member 104 based on the type and style of the basketball assembly 200. The rear surface 105 is the portion of the mounting bracket 102 which comes in contact with the backboard 202. In additional embodiments, the rear surface 105 may have a plurality of apertures to coincide with the mounting hardware for the rim 204.

Figure 6:
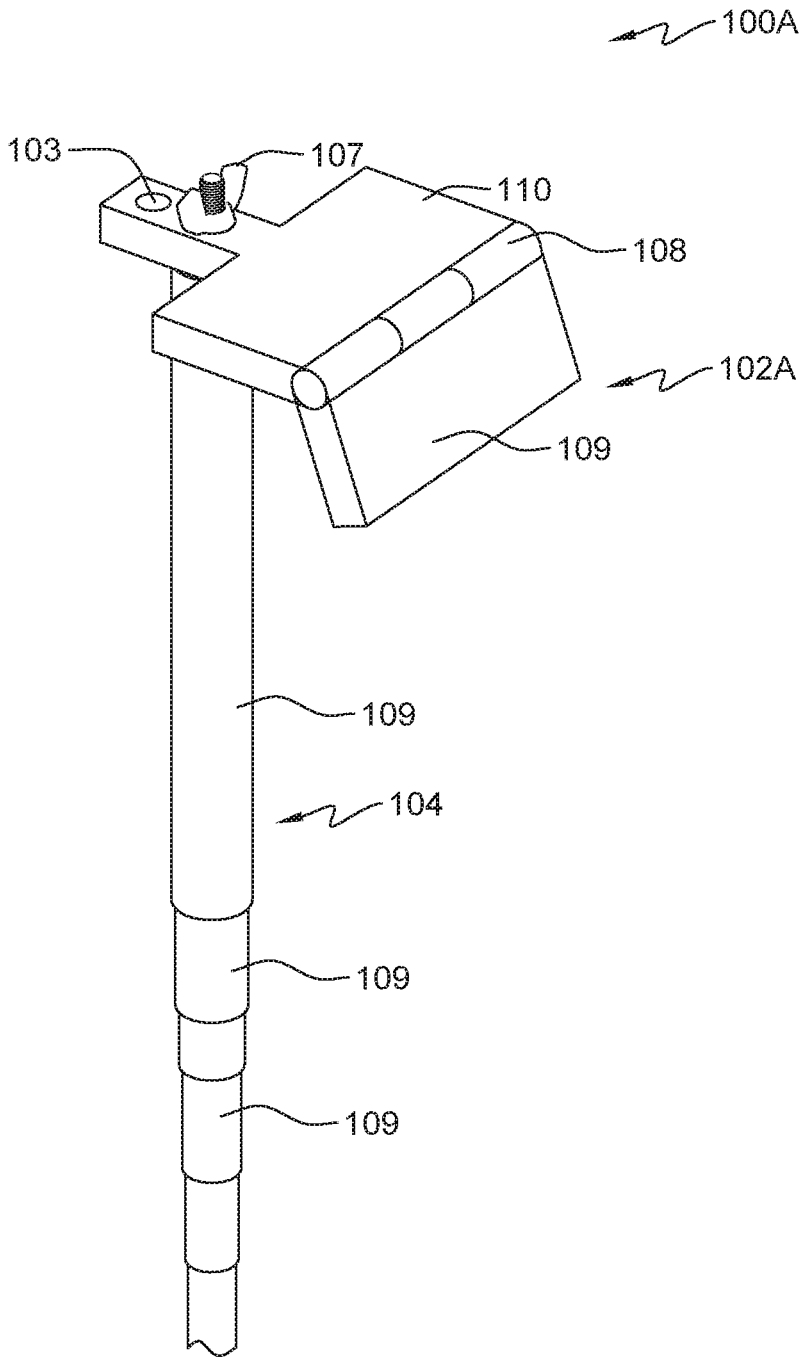
FIG. 6 depicts a perspective view of the targeting apparatus, in accordance with another embodiment of the present invention.

FIG. 6 depicts an additional embodiment of the targeting apparatus 100A. In the depicted embodiment the mounting bracket 102A has a hinge 108 between a top plate 110 and a rear plate 109. The hinge 108 also the adjustment of the angle of the vertical member 104 when the targeting apparatus 100A is mounted onto a backboard 202. In some embodiments, the hinge 108 has an integrated locking mechanism, or is able to snap into a plurality of different positions. This allows for the player or a coach to easily transition from having the targeting apparatus 100 in an "active" position, to a variety of "inactive" positions without the need to remove the entire targeting apparatus 100 from the backboard 202. In some embodiments, the hinged bracket, and the vertical member 104 are assembled and attached to the backboard 202 in one of the many methods described above. In additional embodiments, the vertical member 104 may also have the direction marker 106 attached as well. The hinge may have additional positions between the first and second position depending on the intended use of the vertical member 104. In some embodiments, the hinge has a locking mechanism to secure the vertical member 104 in a preferred position.

The proper method of using the invention is when properly installed, a player identifies the location on the backboard, where the direction marker 106 and the vertical member 104 intersect. The player then aims for the intersection of these two components. Provided the shot angle, ball rotation, and body momentum remain constant, the player is more likely to successfully complete a bank shot at aiming at the intersection point.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of this invention.

What is claimed is:

1. A static targeting apparatus for a basketball assembly, comprising:

a mounting bracket secured to a rear surface of a basketball backboard, wherein the mounting bracket is secured based on a center of a rim;

a vertical member having a first end and a second end, wherein the vertical member is attached to the mounting bracket at a first end and is positioned at least 3 inches behind a front surface of the backboard; and a direction marker attached to the front surface of the basketball backboard, wherein, the direction marker is positioned at least 12 inches above the rim and centered about the mounting bracket, and resembles a trapezoidal shape with a base member and at least two lateral sides, wherein the vertical member and the direction marker forming a targeted intersection for shooting backboard shots to hit the intersection.

2. The static targeting apparatus for basketball of claim 1, wherein the vertical member is telescopic.

3. The static targeting apparatus for basketball of claim 1, further comprising a stability bracket, wherein the stability bracket attaches to the second end of the vertical member and the backboard.

4. The static targeting apparatus for basketball of claim 1, wherein the mounting bracket further comprises a hinge, wherein the hinge has a plurality of positions, wherein the hinge can be locked in at least one of the positions.

5. The static targeting apparatus for basketball of claim 1, wherein the vertical member further comprises a plurality of indicators positioned along the vertical member.

6. The static targeting apparatus for basketball of claim 1, wherein the direction marker is comprised of a horizontal member having a first end and second end, and a first side extending from the first end at a predetermined angle and a second side extending from the second end at a predetermined angle.

7. The static targeting apparatus for basketball of claim 1, wherein the vertical member is positioned 3.326 inches from a front surface of the backboard and extends substantially in line with a center line of the backboard.

8. The static targeting apparatus for basketball of claim 7, wherein the direction marker is placed 12.86 inches above the rim, has first portion that extends 1.925 inches from the center line of the backboard, and the angled sides extending from the horizontal member at an angle of approximately 126.822 degrees.

9. The static targeting apparatus for basketball of claim 1, wherein the mounting bracket has an "L" shape design with a first end having a plurality of apertures for attaching the vertical member, and a second end designed to secure to the backboard.

10. The static targeting apparatus for basketball of claim 1, wherein the direction marker is comprising:

a base member having a first end and a second end and is substantially parallel to the rim;

a first lateral side affixed to the first end of the base member and extending at a first predetermined angle from the base portion; and a second lateral side affixed to the second end of the base member and extending at a first predetermined angle from the base portion.

11. The static targeting apparatus for basketball of claim 10, wherein the first and second predetermined angles are substantially equal.

12. The static targeting apparatus for basketball of claim 10, wherein the first and second lateral sides of the direction marker are substantially equal lengths.

13. The static targeting apparatus for basketball of claim 10, wherein the vertical member is at substantially first and second lateral sides of the direction marker are substantially 3.32 inches from the backboard.

14. A static targeting apparatus for a basketball assembly, comprising:

a vertical member affixed to a backboard, wherein the vertical member is substantially 3.3 inches from a front surface of the backboard; and a direction marker attached to the front surface of the basketball backboard, wherein, the direction marker is positioned substantially 12.8 inches above the rim, wherein the vertical member and the direction marker forming an parallax for shooting backboard shots to hit the parallax.

15. The static targeting apparatus for basketball of claim 14, wherein a base edge of the direction markers is shorter than a top edge of the direction markers.

* * * * *